US010695249B2

(12) United States Patent
Rapoport

(10) Patent No.: US 10,695,249 B2
(45) Date of Patent: Jun. 30, 2020

(54) PREMATURE NEONATE CLOSED LIFE SUPPORT SYSTEM

(71) Applicant: Aspect Imaging Ltd., Shoham (IL)

(72) Inventor: Uri Rapoport, Moshav Ben Shemen (IL)

(73) Assignee: ASPECT IMAGING LTD., Shoham (IL)

( * ) Notice: Subject to any disclaimer, the term of this patent is extended or adjusted under 35 U.S.C. 154(b) by 0 days.

(21) Appl. No.: 15/424,428

(22) Filed: Feb. 3, 2017

(65) Prior Publication Data

US 2017/0143569 A1 May 25, 2017

Related U.S. Application Data

(63) Continuation of application No. 13/233,515, filed on Sep. 15, 2011, now Pat. No. 9,597,246.
(Continued)

(30) Foreign Application Priority Data

Sep. 15, 2011 (DE) ..... 20 2011 051 313 U

(51) Int. Cl.
*A61G 11/00* (2006.01)

(52) U.S. Cl.
CPC ..... *A61G 11/00* (2013.01); *A61G 11/009* (2013.01)

(58) Field of Classification Search
CPC .. A61G 11/001; A61G 11/002; A61G 11/005; A61G 11/006; A61G 11/007;
(Continued)

(56) References Cited

U.S. PATENT DOCUMENTS 1,900,342 A 3/1933 Hess
2,638,087 A 5/1953 Livsey
(Continued)

FOREIGN PATENT DOCUMENTS

CA 2815746 5/2012
CN 2448344 9/2001
(Continued)

OTHER PUBLICATIONS

Ranganna et al., Reducing noise on the neonatal unit, Infant, 2011, vol. 7, Issue 1, pp. 25-28.
(Continued)

*Primary Examiner* — Navin Natnithithadha
*Assistant Examiner* — Sunita Reddy
(74) *Attorney, Agent, or Firm* — Loeb & Loeb LLP

(57) ABSTRACT

A premature neonate closed life support system (NCLSS) including: at least one chamber confining a cradle-like neonate support (CLNS) having suitable dimensions and geometric-configuration for accommodating at least one premature neonate having at least two operational configurations, said operational configurations comprising: a first operational OPEN configuration whereby said CLNS is adapted to couple said neonate to at least one life supporting system by means of at least one life supporting coupling line, prior to positioning said CLNS in a medical device; and a second operational air-tight CLOSED configuration whereby said neonate remains continuously coupled to said at least one supporting system by means of at least one life supporting coupling line, when positioning said CLNS within said medical device. The OPEN and CLOSED configurations are reversible.

5 Claims, 3 Drawing Sheets

Related U.S. Application Data

(60) Provisional application No. 61/383,349, filed on Sep. 16, 2010.

(58) Field of Classification Search
CPC .. A61G 11/008; A61G 11/009; A61G 11/004; A61G 11/00
USPC ..... 600/21–22
See application file for complete search history.

(56) References Cited

U.S. PATENT DOCUMENTS 2,708,927 A 5/1955 Dixon et al.
3,012,836 A 12/1961 Smith et al.
3,315,671 A 4/1967 Creelman
3,470,866 A 10/1969 Gittelson
3,655,178 A 4/1972 Vezina
3,710,791 A 1/1973 Deaton
3,920,000 A 11/1975 Atherton et al.
4,161,172 A 7/1979 Pickering
4,509,505 A 4/1985 Mercey et al.
4,543,959 A 10/1985 Sepponen
4,567,894 A 2/1986 Bergman
4,613,820 A 9/1986 Edelstein
4,712,263 A * 12/1987 Pronzinski ..... A61G 11/00 128/872
4,750,474 A 6/1988 Dukhan et al.
4,875,485 A 10/1989 Matsutani
4,936,824 A 6/1990 Koch et al.
4,968,961 A 11/1990 Miyajima
5,028,872 A 7/1991 Nakabayashi
5,059,906 A 10/1991 Yamanaka
5,100,375 A 3/1992 Koch
5,153,546 A 10/1992 Laskaris
5,372,137 A 12/1994 Wong
5,436,607 A 7/1995 Chari
5,446,934 A 9/1995 Frazier
5,534,669 A 7/1996 Schroeder et al.
5,565,831 A 10/1996 Dorri
5,759,149 A 6/1998 Goldberg et al.
5,797,833 A 8/1998 Kobayashi et al.
5,800,335 A 9/1998 Koch et al.
5,817,003 A 10/1998 Moll et al.
5,883,558 A 3/1999 Laskaris
5,917,324 A 6/1999 Leussler
5,943,716 A * 8/1999 Chu ..... A47C 29/003 5/423
5,971,913 A 10/1999 Newkirk et al.
6,036,634 A 3/2000 Goldberg et al.
6,128,522 A 10/2000 Acker
6,155,970 A * 12/2000 Dykes ..... A61G 11/00 5/610
6,157,278 A 12/2000 Katznelson
6,208,142 B1 3/2001 Wagshul
6,228,106 B1 5/2001 Simbruner et al.
6,231,499 B1 5/2001 Jones
D446,675 S 8/2001 Straub
6,278,274 B1 8/2001 Biglieri
6,317,618 B1 11/2001 Livni et al.
6,323,647 B1 11/2001 Anderson
6,409,654 B1 6/2002 McClain et al.
6,433,548 B1 8/2002 Furuta et al.
6,471,634 B1 10/2002 Dykes et al.
6,511,414 B1 1/2003 Hamsund
6,611,702 B2 8/2003 Rohling et al.
6,641,521 B2 11/2003 Kolarovic
6,666,816 B2 12/2003 Mountain
RE38,453 E 3/2004 Lessard et al.
6,776,527 B1 8/2004 Tybinkowski et al.
6,860,272 B2 3/2005 Carter et al.
6,992,486 B2 1/2006 Srinivasan
7,071,692 B2 7/2006 Branch
7,255,671 B2 8/2007 Boone et al.
7,274,192 B2 9/2007 Havens
7,278,962 B2 10/2007 Lonneker-Lammers
D567,948 S 4/2008 Tierney et al.
7,378,848 B2 5/2008 Gao
7,482,558 B2 * 1/2009 Koch ..... A61G 11/00 219/203
7,486,982 B2 2/2009 Branch
7,599,728 B2 10/2009 Feenan
7,614,692 B2 11/2009 Biaud
7,621,815 B2 11/2009 Bosserdet, Jr.
7,777,491 B2 8/2010 Gao
7,784,121 B2 8/2010 Ahlman
8,087,203 B2 1/2012 Boesel
8,118,488 B2 2/2012 Gregerson
8,147,396 B2 4/2012 Srinivasan
8,525,116 B2 9/2013 Schulz
8,555,578 B2 10/2013 Hushek
8,807,084 B2 8/2014 Rapoport
8,851,018 B2 10/2014 Rapoport et al.
8,896,310 B2 11/2014 Rapoport
9,055,912 B2 6/2015 Graumann
9,597,246 B2 * 3/2017 Rapoport ..... A61G 11/00
9,974,705 B2 5/2018 Rapoport
2001/0049465 A1 12/2001 Goldberg et al.
2002/0072648 A1 6/2002 Dykes et al.
2002/0123681 A1 9/2002 Zuk et al.
2002/0143233 A1 10/2002 Donnelly et al.
2002/0173696 A1 11/2002 Kolarovic et al.
2002/0173717 A1 11/2002 Rohling et al.
2003/0016518 A1 1/2003 Arz
2003/0088175 A1 5/2003 Branch et al.
2004/0030241 A1 2/2004 Green et al.
2004/0034273 A1 2/2004 Boris
2004/0106844 A1 6/2004 Lonneker-Lammers
2004/0116799 A1 6/2004 Srinivasan
2004/0127786 A1 7/2004 Schmit
2004/0133064 A1 7/2004 Castillon Levano et al.
2004/0135687 A1 7/2004 Keene
2004/0147833 A1 7/2004 Czipott
2004/0186341 A1 9/2004 McDermott
2004/0190643 A1 9/2004 Liu
2004/0194989 A1 10/2004 Branch
2004/0196043 A1 * 10/2004 Branch ..... G01R 33/422 324/318
2004/0236174 A1 * 11/2004 Boone ..... A61G 11/006 600/21
2004/0236175 A1 11/2004 Boone et al.
2005/0004422 A1 1/2005 Caspary et al.
2005/0020906 A1 1/2005 Seijger et al.
2005/0027189 A1 2/2005 Branch
2005/0038314 A1 2/2005 Falk
2005/0113668 A1 * 5/2005 Srinivasan ..... A61B 5/416 600/411
2006/0079730 A1 4/2006 Getsla
2006/0247487 A1 * 11/2006 Arts ..... A61G 10/005 600/21
2006/0267585 A1 11/2006 Havens
2007/0056593 A1 * 3/2007 Kubicsko ..... A61F 5/3769 128/846
2007/0135704 A1 6/2007 Branch
2007/0232894 A1 10/2007 Feenan
2007/0238950 A1 10/2007 Vija
2008/0103388 A1 5/2008 Maschke
2008/0122441 A1 5/2008 Hayakawa
2008/0163425 A1 * 7/2008 White ..... A61G 7/0503 5/603
2008/0171931 A1 7/2008 Maschke
2008/0204028 A1 8/2008 DeVries
2008/0234571 A1 9/2008 Hay
2008/0281187 A1 11/2008 Massengill
2009/0044335 A1 2/2009 Brewin et al.
2009/0209846 A1 8/2009 Bammer
2010/0004502 A1 * 1/2010 Honma ..... A61G 11/00 600/22
2010/0010599 A1 1/2010 Chen et al.
2010/0066368 A1 3/2010 Gao
2010/0145358 A1 6/2010 Maschke
2010/0154325 A1 6/2010 Boesel
2010/0168502 A1 * 7/2010 Delaporte ..... A61G 11/00 600/22

(56) References Cited

U.S. PATENT DOCUMENTS

| | | | | |
|---|---|---|---|---|
| 2010/0219347 | A1 | 9/2010 | Schulz | |
| 2010/0245543 | A1 | 9/2010 | Greer | |
| 2011/0048424 | A1 | 3/2011 | Radko | |
| 2011/0113555 | A1 | 5/2011 | Smith | |
| 2011/0125010 | A1* | 5/2011 | Vaquero Lopez | A61B 5/0059 600/427 |
| 2011/0160521 | A1 | 6/2011 | Khodak et al. | |
| 2011/0162652 | A1 | 7/2011 | Rapoport | |
| 2011/0186049 | A1 | 8/2011 | Rapoport | |
| 2011/0234347 | A1 | 9/2011 | Rapoport | |
| 2011/0274238 | A1 | 11/2011 | Maschke | |
| 2011/0280364 | A1 | 11/2011 | Maschke | |
| 2011/0280380 | A1 | 11/2011 | Maschke | |
| 2011/0282184 | A1 | 11/2011 | Klingenbeck | |
| 2011/0304333 | A1 | 12/2011 | Rapoport | |
| 2012/0071745 | A1 | 3/2012 | Rapoport | |
| 2012/0073511 | A1 | 3/2012 | Rapoport et al. | |
| 2012/0077707 | A1 | 3/2012 | Rapoport | |
| 2012/0078034 | A1 | 3/2012 | Falk et al. | |
| 2012/0119742 | A1 | 5/2012 | Rapoport | |
| 2012/0126814 | A1 | 5/2012 | Fischer et al. | |
| 2013/0025062 | A1 | 1/2013 | Esch | |
| 2013/0079624 | A1 | 3/2013 | Rapoport | |
| 2013/0109956 | A1 | 5/2013 | Rapoport | |
| 2013/0150656 | A1 | 6/2013 | Falk et al. | |
| 2013/0204074 | A1 | 8/2013 | Belval et al. | |
| 2013/0204617 | A1 | 8/2013 | Kuo et al. | |
| 2013/0237803 | A1 | 9/2013 | Rapoport | |
| 2013/0267765 | A1 | 10/2013 | Rapoport | |
| 2013/0328559 | A1 | 12/2013 | Rapoport | |
| 2013/0328560 | A1 | 12/2013 | Rapoport | |
| 2013/0328563 | A1 | 12/2013 | Rapoport | |
| 2013/0334439 | A1 | 12/2013 | Etters | |
| 2014/0003614 | A1 | 1/2014 | Levitov et al. | |
| 2014/0050827 | A1 | 2/2014 | Rapoport | |
| 2014/0051973 | A1 | 2/2014 | Rapoport et al. | |
| 2014/0051974 | A1 | 2/2014 | Rapoport et al. | |
| 2014/0051976 | A1 | 2/2014 | Rapoport et al. | |
| 2014/0078301 | A1 | 3/2014 | Fazzi et al. | |
| 2014/0098934 | A1 | 4/2014 | Kondo | |
| 2014/0099010 | A1 | 4/2014 | Rapoport | |
| 2014/0103927 | A1 | 4/2014 | Rapoport | |
| 2014/0117989 | A1 | 5/2014 | Rapoport | |
| 2014/0128725 | A1 | 5/2014 | Rapoport | |
| 2014/0139216 | A1 | 5/2014 | Rapoport | |
| 2014/0142914 | A1 | 5/2014 | Rapoport | |
| 2014/0152302 | A1 | 6/2014 | Rapoport et al. | |
| 2014/0152310 | A1 | 6/2014 | Rapoport | |
| 2014/0158062 | A1 | 6/2014 | Rapoport et al. | |
| 2014/0230850 | A1 | 8/2014 | Rapoport | |
| 2014/0257081 | A1 | 9/2014 | Rapoport | |
| 2014/0266203 | A1 | 9/2014 | Rapoport | |
| 2014/0300358 | A1 | 10/2014 | Rapoport | |
| 2014/0354279 | A1 | 12/2014 | Dumoulin et al. | |
| 2014/0357981 | A1 | 12/2014 | Dumoulin | |
| 2014/0364722 | A1 | 12/2014 | Dumoulin | |
| 2014/0378821 | A1 | 12/2014 | Rapoport et al. | |
| 2014/0378825 | A1 | 12/2014 | Rapoport et al. | |
| 2015/0005618 | A1 | 1/2015 | Dumoulin | |
| 2015/0059157 | A1 | 3/2015 | Rapoport | |
| 2015/0059655 | A1 | 3/2015 | Rapoport | |
| 2015/0065788 | A1 | 3/2015 | Rapoport | |
| 2015/0077105 | A1 | 3/2015 | Rapoport | |
| 2015/0137812 | A1 | 5/2015 | Rapoport | |
| 2015/0141799 | A1 | 5/2015 | Rapoport et al. | |
| 2015/0226817 | A1 | 8/2015 | Pourrahimi | |
| 2015/0230766 | A1 | 8/2015 | Wang | |
| 2016/0030264 | A1* | 2/2016 | Lehmann | A61M 16/161 600/22 |
| 2016/0081582 | A1 | 3/2016 | Rapoport | |
| 2016/0089054 | A1 | 3/2016 | Rapoport | |
| 2017/0143271 | A1 | 5/2017 | Gustafsson | |
| 2017/0146619 | A1 | 5/2017 | Strauss | |
| 2017/0181912 | A1 | 6/2017 | Rapoport | |

FOREIGN PATENT DOCUMENTS

| | | |
|---|---|---|
| CN | 101185383 | 5/2008 |
| CN | 201846566 | 5/2011 |
| CN | 102551719 A | 7/2012 |
| DE | 19617739 | 6/1997 |
| DE | 102008009673 | 8/2009 |
| DE | 102008009674 | 8/2009 |
| EP | 0187691 | 7/1986 |
| EP | 1132072 | 9/2001 |
| EP | 2581071 | 4/2013 |
| EP | 2607977 | 6/2013 |
| IL | 226488 | 7/2016 |
| JP | S5961763 | 4/1984 |
| JP | H04317630 | 11/1992 |
| JP | 2004531313 | 10/2004 |
| JP | 2005514078 | 5/2005 |
| JP | 2007252741 | 10/2007 |
| JP | 2010178857 | 8/2010 |
| JP | 2016539683 | 12/2016 |
| WO | WO1998048756 | 11/1998 |
| WO | WO9921526 | 5/1999 |
| WO | 2004029644 | 4/2004 |
| WO | WO2008137003 | 11/2008 |
| WO | WO2010054457 | 5/2010 |
| WO | WO2011109761 | 9/2011 |
| WO | 2012004797 | 1/2012 |
| WO | WO2012143825 | 10/2012 |
| WO | WO2013115847 | 8/2013 |

OTHER PUBLICATIONS

Jenkins, S., ScanPod, BabyPod-Products-ScanPod, 2002-2011 Advance Healthcare Technology, ltd., internet website http://babypod.com:80/products/scanpod.php.

Science Daily, Inside the preemie brain, Incubator enables MRI scans on premeeies for preventing birth asphyxia, Dec. 1, 2005, pp. 1-2, Web address: http://web.archive.org/web/20130303154220/http://www.sciencedaily.com/videos/2005/1211-inside_the_preemie_brain.htm.

Kitterman et al., Catheterization of umbilical vessels in newborn infants, Pediatric Clinics of North America, vol. 17, No. 4, Nov. 1970, 895-912.

Thermaxx Jackets, 5 most common thermal insulation materials, pp. 1-4, internet: https://www.thermaxxjackets.com/5-most-common-thermal-insulation-materials/.

ASPECT IMAGING LTD. "MRI RF Shielding Jacket", co-pending U.S. Appl. No. 14/623,051, filed Feb. 16, 2015.

ASPECT IMAGING LTD. "MRI Thermo-Isolating Jacket", co-pending U.S. Appl. No. 14/623,039, filed Feb. 16, 2015.

ASPECT IMAGING LTD., "Cage in an MRD with a Fastening/Attenuating System", co-pending U.S. Appl. No. 14/527,950, filed Oct. 30, 2014.

ASPECT IMAGING LTD., "Foamed Patient Transport Incubator", co-pending U.S. Appl. No. 14/531,289, filed Nov. 3, 2014.

ASPECT IMAGING LTD., "Incubator Deployable Multi-Functional Panel", co-pending U.S. Appl. No. 14/619,557, filed Feb. 11, 2015.

ASPECT IMAGING LTD., "Incubator's Canopy with Sensor Dependent Variably Transparent Walls and Methods for Dimming Lights Thereof", co-pending U.S. Appl. No. 14/453,909, filed Aug. 7, 2014.

ASPECT IMAGING LTD., "Means and Method for Operating an MRI Device Within a RF-Magnetic Environment", copending U.S. Appl. No. 14/596,329, filed Jan. 14, 2015.

ASPECT IMAGING LTD., "Means for Operating an MRI Device Within a RF-Magnetic Environment", co-pending U.S. Appl. No. 14/596,320, filed Jan. 14, 2015.

ASPECT IMAGING LTD., "Mechanical Clutch for MRI", co-pending U.S. Appl. No. 14/611,379, filed Feb. 2, 2015.

ASPECT IMAGING LTD., "Shutting Assembly for Closing an Entrance of an MRI Device", co-pending U.S. Appl. No. 14/540,163, filed Nov. 13, 2014.

(56) References Cited

OTHER PUBLICATIONS

Eberich et al., Functional MRI in neonates using neonatal head coil and MR compatible incubator, NeuroImage 20 (2003) 683-692.
International Search Report of PCT Application No. PCT/IL2014/050987, dated Mar. 16, 2015.
Israeli Office Action (with English language translation) for Application No. IL245643, dated Dec. 8, 2019, 6 pages.
Rapoport, Uri, "RF Shielding Conduit in an MRI Closure Assembly", co-pending U.S. Appl. No. 14/574,785, filed Dec. 18, 2014.
Antonucci, et al., The infant incubator in the neonatal intensive care unit: unresolved issues and future developments, J. Perinat. Med. 37(2009), 587-598.
Baby Pod II Infant Transport Device, Advance Healthcare Technology, brochure, pp. 1-6.
Baby Pod II Operation and Maintenance Manual, revision 5, Jan. 2011, pp. 1-11.
Ferris et al., The design of neonatal incubators: a systems-oriented, human centered approach, J. Perinatology, 2013, 33, S24-S31.
Kim et al., Air transparent soundproof window, AIP ADVANCES 4, 117123 (2014), published online, doi: https://doi.org/10.1063/1.4902155.
Knutson, Allysa Jennie, Acceptable noise levels for neonates in the neonatal intensive care unit, A Capstone Project submitted in partial fulfillment of the requirements for the degree of: Doctor of Audiology, Washington University School of Medicine Program in Audiology and Communication Sciences, May 17, 2013, pp. 1-59.
Liu, Lichuan et al., Development and Applications of Active Noise Control System for Infant Incubators, Proceedings of the 2009 IEEE International Conference on Systems, Man, and Cybernetics San Antonio, TX, USA—Oct. 2009, pp. 1-6.
Mahil et al., Hybrid Swarm Algorithm for the Suppression of Incubator Interference in Premature Infants ECG, Research Journal of Applied Sciences, Engineering and Technology 6(16): 2931-2935, 2013.
Marik et al., Neonatal incubators: A toxic sound environment for the preterm infant?, Pediatr Crit Care Med 2012 vol. 13, No. 6, pp. 1-6.
Paley et al., An MR-compatible neonatal incubator, The British Journal of Radiology, 85, 2012, 952-958.
American National Standard. Medical Electrical Equipment—Parts 2-19: Particular requirements for the basic safety and essential performance of infant incubators, Association for the advancement of medical instrumentation, ANSI/AAI/IEC 60601-2-19:2009, pp. 1-19.

* cited by examiner

PREMATURE NEONATE CLOSED LIFE SUPPORT SYSTEM

CROSS-REFERENCE TO RELATED APPLICATIONS

This application claims priority from U.S. patent application Ser. No. 13/233,515, filed Sep. 15, 2011 and U.S. Provisional Patent Application No. 61/383,349, filed Sep. 16, 2010, which are hereby incorporated in entirety by reference.

FIELD OF THE INVENTION

The present invention generally pertains to a catheter with a premature neonate closed life support system for use in medical devices, especially a portable MRD device

BACKGROUND OF THE INVENTION

Neonates are typically accommodated in incubators in a dedicated premature baby ward or department of a hospital. The incubators are typically not robust and the general health of the neonate is often compromised. Each disturbance or perturbation of the neonate can have deleterious consequences. Nevertheless it is often essential to transfer the neonate to MRI devices and rooms located at a distance from the premature baby ward. This entails disconnecting the neonate from life supporting connection lines and systems and then reconnecting the life supporting connection lines and systems. Such activities may be dangerous to the neonate patients.

Various patent documents describe a variety of incubators especially designed for used in conjunction with an MRI device. These prior art incubators a temporary disconnection of the neonate from the life supporting lines and systems can be required. Hence, for example, U.S. Published Patent Application No. 2007/0232894 to Feenan provides an extendable carriage configured to shuttle between the neonate incubator and the magnetic resonance incubator system. U.S. Pat. No. 6,611,702 to Rohling provides an enclosure coupled to life support mechanisms and adapted to maintain a selected environment. An RF coil is included within the enclosure. U.S. Pat. No. 5,800,335 to Koch provides a specialized incubator for use in tomography, as does U.S. Pat. No. 7,278,962 to Lonneker-Lammers.

None of the above prior art systems provide a solution for transferring a neonate from an incubator to the MRI device. Providing devices and methods for transferring a neonate, whilst avoiding dangerous exposure of the neonate to the external environment and without endangering the neonate by disconnection of the life supporting connection lines, would fulfill a long felt need.

SUMMARY OF THE INVENTION

It is thus one object of the invention to disclose a premature neonate closed life support system (NCLSS). The NCLSS comprises at least one chamber confining a cradle-like neonate support (CLNS) sized and shaped for accommodating at least one premature neonate and reversibly transformable, from an OPEN configuration, in which the CLNS is adapted to couple the neonate to at least one life supporting connection line life and supporting systems to an air-tight CLOSED configuration, in which the CLNS is suitably placed within a medical device. The transformation of the chamber from the OPEN configuration to the air-tight CLOSED configuration is provided while the neonate is continuously coupled to the at least one life supporting connection line and life supporting systems.

It is another object of the invention to disclose an NCLSS as defined above, wherein the medical device is an MRD, and wherein the CLNS is constructed from magnetic field permeable materials It is another object of the invention to disclose an NCLSS as defined above, wherein the at least one life supporting connection line and life supporting systems are one or more members of a group consisting of fluids, air condition inlet and outlets; anesthetic gas; oxygen; liquids; water; food supply, connectors and applicators of medical devices and monitors thereof, or any combination thereof.

It is another object of the invention to disclose an NCLSS as defined above, wherein the cradle-like neonate support is constructed from a plurality of maneuverable flaps.

It is another object of the invention to disclose an NCLSS as defined above, wherein the NCLSS comprises a CLNS, reversibly transformable from an OPEN CONFIGURATION, locatable within a commercially available neonate incubator to a CLOSED configuration defined as a continuous life supporting capsule locatable within a commercially available MRD device. The CLNS is air-tight and fluidly-sealable and constructed from magnetic field permeable materials, the CLNS in its OPEN configuration is configured to maintain life support coupling of the neonate in the CLOSED configuration, wherein the relocation of the neonate from the cradle of the OPEN CLNS within the incubator to the air-tight CLOSED CLNS within the MRD, and vice versa, is provided by a single step insertion without decoupling or recoupling of the CLNS with life supporting connection lines.

It is still another object of the invention to disclose a method of transferring a neonate from an incubator to a medical device, such as an MRI device, without decoupling the neonate from the life supporting connection lines and life supporting systems. The method comprises, inter alia, steps of providing at least one premature neonate closed life support system (NCLSS) with at least one chamber comprising a cradle-like neonate support (CLNS); providing the CLNS, by means of size and shape for accommodating the at least one premature neonate; placing the neonate within or on top of the CLNS; transforming the CLNS from an OPEN configuration, in which the CLNS is adapted to couple the neonate with at least one life supporting connection line life and supporting systems to an air-tight CLOSED configuration in which the chamber is suitably placed within a medical device, such as an MRD; and transferring the neonate, placed within the CLOSED configuration CLNS to the medical device such that that the transformation of the CLNS from the OPEN configuration to the air-tight CLOSED configuration is provided while the neonate is continuously coupled to the at least one life supporting connection line and life supporting systems.

It is another object of the invention to disclose a method as defined above, wherein the method additionally comprises the steps of (i) providing the air-tight CLOSED configuration to be permeable to magnetic fields; and (ii) providing the CLNS suitable to be placed within an MRD device.

BRIEF DESCRIPTION OF THE DRAWINGS

The present invention will be more readily understood from the detailed description of embodiments thereof made in conjunction with the accompanying drawings of which.

DETAILED DESCRIPTION OF THE PREFERRED EMBODIMENTS

The following description is provided, alongside all chapters of the present invention, to enable any person skilled in the art to make use of the invention and sets forth the best modes contemplated by the inventor of carrying out this invention. Various modifications, however, will remain apparent to those skilled in the art, since the generic principles of the present invention have been defined specifically to provide a premature neonate closed life support system and methods thereof.

The term 'magnetic resonance device' (MRD) specifically applies hereinafter to any Magnetic Resonance Imaging (MRI) device, any Nuclear Magnetic Resonance (NMR) spectroscope, any Electron Spin Resonance (ESR) spectroscope, any Nuclear Quadruple Resonance (NQR) or any combination thereof. The MRD hereby disclosed is optionally a portable MRI device, such as the ASPECT-MR Ltd commercially available devices, or a commercially available non-portable device. Moreover, the term 'MRD' generally refers to any non-incubator medical devices, at least temporarily accommodating the neonate.

As used herein, the term "neonate" generally refers to any object or living creature, such as human being or other mammal and preferably refers to babies.

As used herein, the term "plurality" refers in a non-limiting manner to any integer equal or greater than 1.

The term 'about' refers herein to a value of ±25% of the defined measure.

Figure 1:
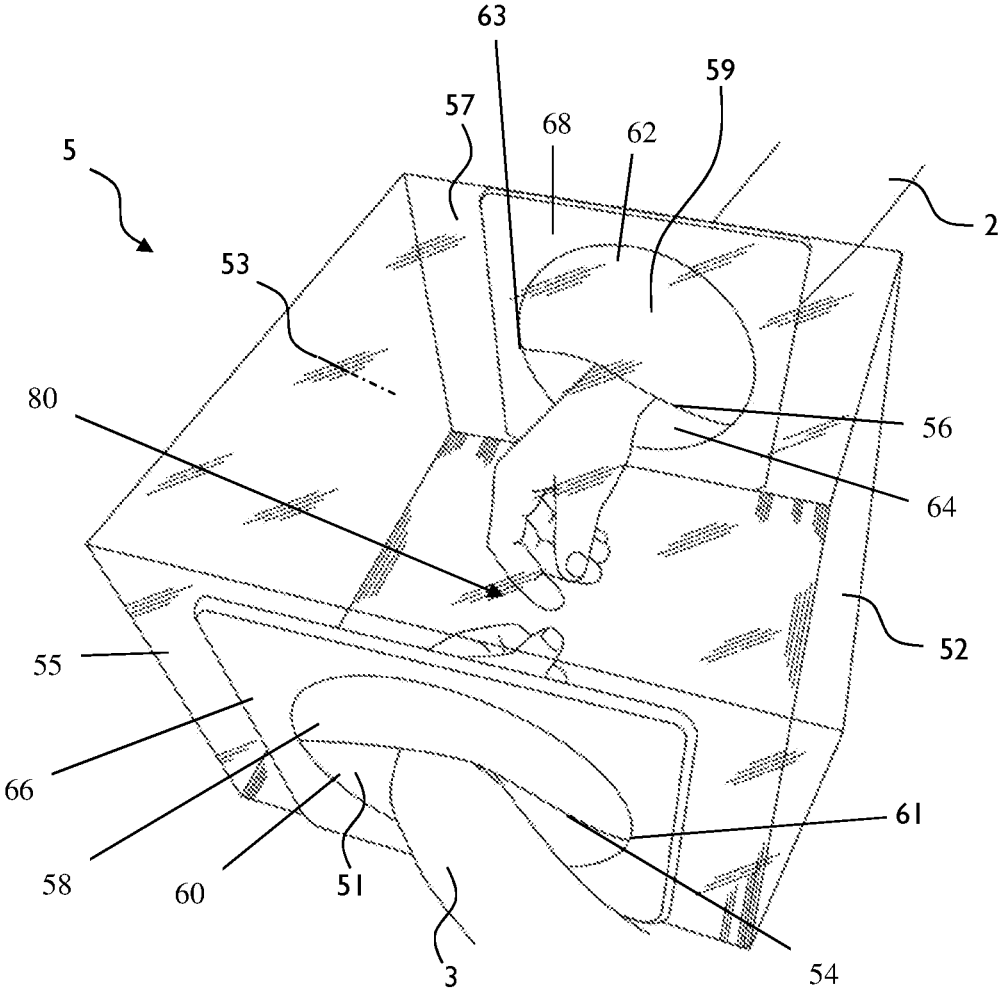
FIG. 1. is a schematic, not to scale illustration of a neonate's incubator, according to an embodiment of the present invention.

Reference is now made to FIG. 1, schematically illustrating in an out-of-scale manner a neonate's incubator. More specifically, an incubator 5 presented in FIG. 1 is provided useful by means of size, shape and dimensions to at least temporarily accommodate in its inner air tight sealed volume 53 a neonate under medical care, e.g., anesthetics, imaging or other diagnostics or treatment. The incubator 5 comprises, inter alia, operator hand access ports, 51 and 59, for operator hands 3 and 2, respectively. Each one of the ports 51 and 59 comprises a port aperture 54 and 56, located on incubator walls 55 and 57, respectively, and at least two pairs of flexible non-resilient lightweight sealing gas-tight flaps (SFs) (58 and 60) and (62 and 64), disposed within the same plane of the port apertures 54 and 56, respectively, in an overlapping manner, thereby entirely enclosing the respective port apertures 54 and 56. Each pair of the SFs (58 and 60) and (62 and 64) is attached to port aperture edges 61 and 63, respectively and incubator supporting flanges 66 and 68, respectively. The incubator flanges 66 and 68 are attached to the incubator walls 55 and 57 and each member of the pair of flaps (58 and 60) and (62 and 64) are in an overlapping arrangement, as shown in FIG. 1. The members of each pair of flaps (58 and 60) and (62 and 64) are stretched across each respective port aperture 54 and 56 thereby enclosing and defining an interior access zone 80, disposed within the same plane of the port aperture and characterized solely by the port flanges 66 and 68 of each pair of SFs (58 and 60) and (62 and 64).

The incubator 5 has a plurality of walls, one of which is wall 52.

Figure 2:
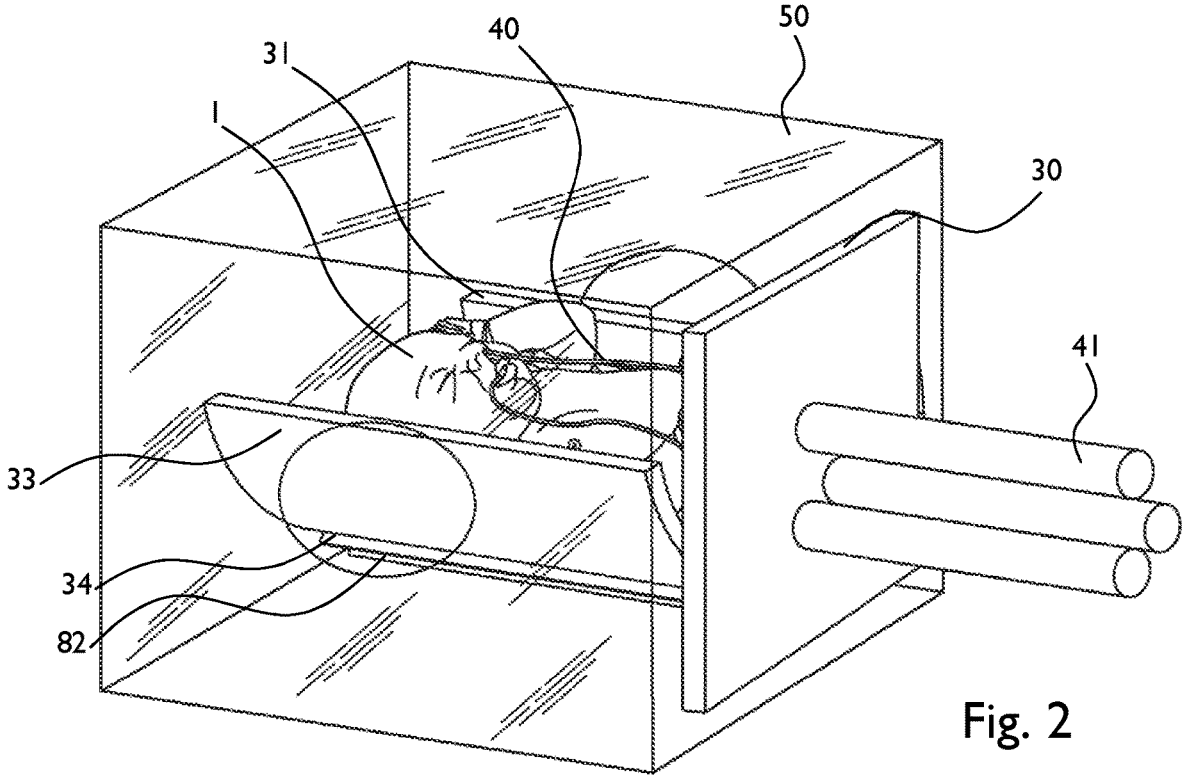
FIG. 2. is a schematic, not to scale illustration of a neonate's incubator showing the location of the premature neonate within the incubator, according to an embodiment of the present invention.

Reference is now made to FIG. 2, schematically illustrating in an out-of-scale manner the neonate's incubator 50, wherein the premature neonate closed life support system (NCLSS) is located within the inner volume of the incubator 50. The NCLSS system comprises, inter alia, at least one chamber comprising a cradle-like neonate support (82) sized and shaped for accommodating at least one premature neonate 1. CLNS is reversibly transformable from an OPEN configuration, as presented in FIG. 2, in which the CLNS is adapted to couple the neonate with at least one life supporting connection line, prior to insertion into a medical device, such as an MRD; to an air tight CLOSED configuration as presented in FIG. 3, in which the chamber is permeable to magnetic fields and suitable to be set within said MRD device.

According to one embodiment of the invention, and in a non-limiting manner, the CLNS is constructed by a plurality of maneuverable flaps, flaps 31-34, wherein in the OPEN configuration, upper flap 33 has a curved cradle-like shape. The neonate 1 is conveniently and safely positioned on top of flap 33. Other curved flaps, namely 32-34, slide beneath flap 31. The CLNS further comprises side wall 30 which is adapted to fit wall 52 as presented in FIG. 1, which is the planar support for communicating a plurality of at least one life supporting connection lines positioned within the incubator, namely lines 40, with those positioned outside the incubator (41). The neonate 1 thus is maintained and treated within incubator 50 or in any commercially available incubator.

Figure 3:
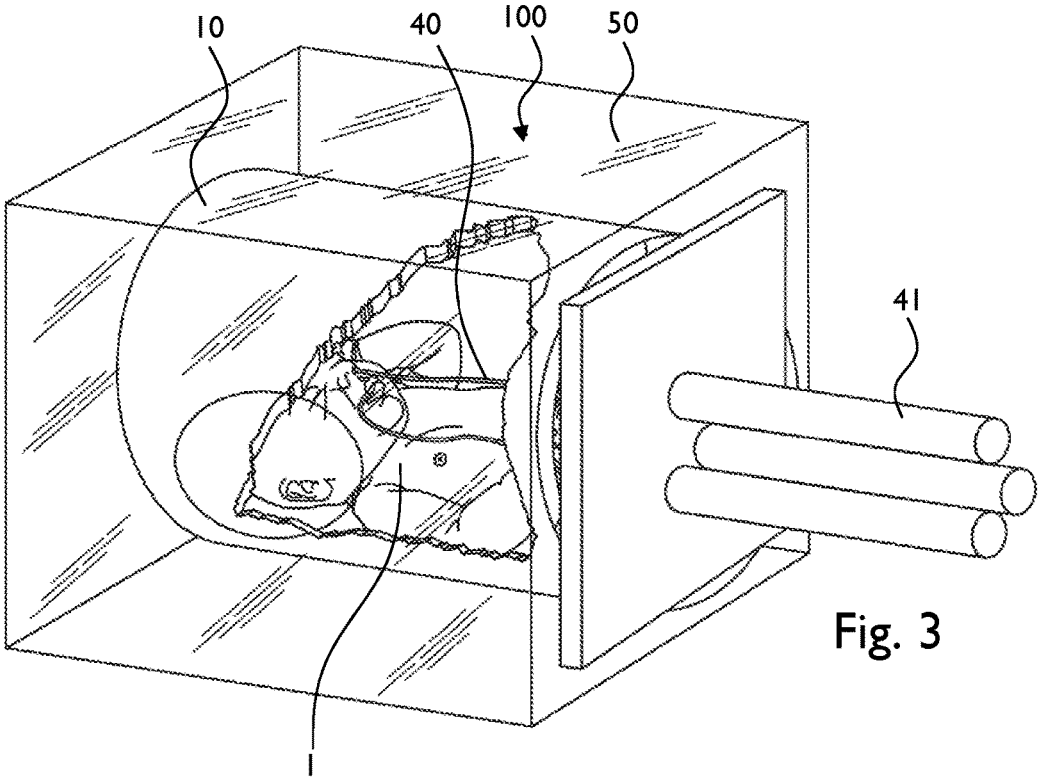
FIG. 3. is a schematic, not to scale illustration of a neonate's incubator of FIG. 2, wherein the premature neonate closed life support system (NCLSS) is located within the inner volume of the incubator, according to an embodiment of the present invention.

Reference is now made to FIG. 3, schematically illustrating in an out-of-scale manner neonate's incubator 50, wherein all flaps are closed to form air tight capsule 100 in the CLOSE configuration. Neonate 1 is enveloped within capsule 100 having a continuous wall or envelope 10, such that the internal life supporting connection lines 40 are in communication with the external life supporting connection lines 41.

Figure 4:
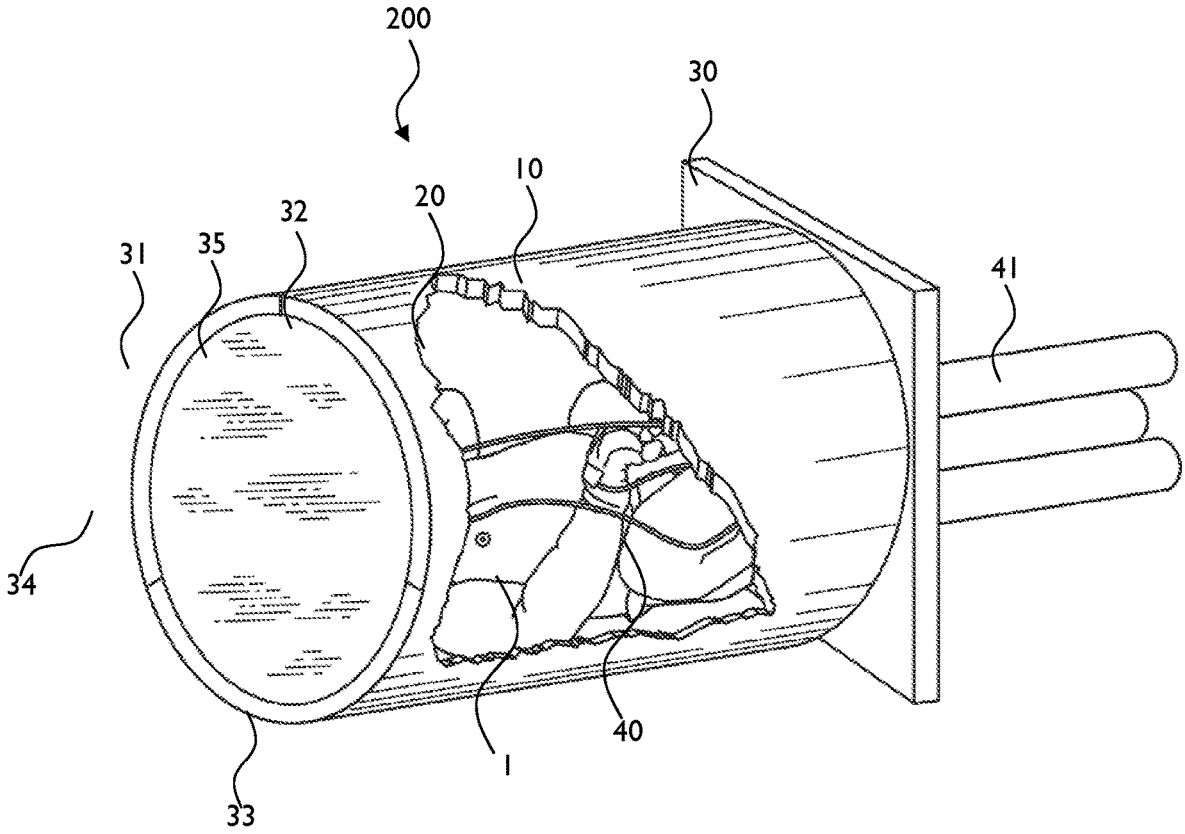
FIG. 4. is a schematic, not to scale illustration of a portable a cradle-like neonate support (CLNS), according to an embodiment of the present invention.

Reference is now made to FIG. 4, schematically illustrating in an out of scale manner a portable CLNS 200. According to the embodiment described above, the walls of air tight capsule 100 comprise a shell 10 constructed by four curved flaps 31-34, side walls 30 and 35. The encapsulated environment, i.e., confined volume 20 within the capsule is separated from the outside by shell 10, such that all life supporting connection lines 40 within the capsule are connected to the same outer life supporting connection lines 41. In this manner, transformation of chamber 10 from its OPEN configuration to its air tight CLOSED configuration is provided while the neonate 1 is continuously maintained connected to the at least one life supporting connection line. Dangerous exposure of the neonate to external environment is avoided. Endangering the patient by disconnection of the life supporting connection lines 40 is overcome.

While the invention is susceptible to various modifications and alternative forms, specific embodiments thereof have been shown by way of example in the drawings and will herein be described in detail. It should be understood, however, that it is not intended to limit the invention to the particular forms disclosed, but on the contrary, the intention is to cover all modifications, equivalents, and alternatives falling within the spirit and scope of the invention as defined by the appended claims.

The invention claimed is:

1. A neonate support for transferring a neonate between an incubator and a medical device, the neonate support comprising:

a curved cradle-shaped support adapted to accommodate said neonate, wherein the curved cradle-shaped support includes one or more curved flaps;

a plurality of other curved flaps, each of the plurality of other curved flaps are moveable between an open position and a closed position and stay continuously directly and slidably connected to said curved cradle-shaped support along a longitudinal axis of the curved cradle-shaped support in both the open position and the closed position;

wherein the plurality of other curved flaps are slid beneath or aside the curved cradle-shaped support to form the open position;

at least one life support connection conduit that extends between an environment that is internal to the neonate support and an environment that is external to the neonate support while the plurality of other curved flaps is in the closed position;

wherein the curved cradle-shaped support is configured to allow positioning of the neonate on top of at least one of the one or more curved flaps, allowing transportation of the neonate support in a closed configuration between the incubator and the medical device while the neonate is continuously connected to at least one life support system via the at least one life support connection conduit without exposing the neonate to the environment that is external to the neonate support.

2. The neonate support according to claim 1, wherein said medical device is a magnetic resonance device.

3. The neonate support according to claim 1, wherein said at least one life support connection conduit includes one or more of fluid-supply conduits, air-conditioning conduits, medication-supply conduits, excretion conduits, and monitoring communication lines.

4. The neonate support according to claim 3, wherein the at least one life support connection conduit is a fluid-supply conduit, and wherein said fluid-supply conduit carries one or more of anesthetic gas, oxygen, life-rendering fluids, water, food supply, and air.

5. The neonate support according to claim 1, wherein while the plurality of other curved flaps is in the closed position, the neonate support is a cylinder-shaped structure.

* * * * *